US007353675B1

(12) United States Patent
Chao et al.

(10) Patent No.: US 7,353,675 B1
(45) Date of Patent: Apr. 8, 2008

(54) LOCK BARREL AND A DRIVING PART FOR THE SAME

(76) Inventors: Sheng-Ho Chao, 235 Chung - Ho Box 8-24, Taipei (TW); Chang-Tung Huang, 235 Chung - Ho Box 8-24, Taipei (TW)

( * ) Notice: Subject to any disclaimer, the term of this patent is extended or adjusted under 35 U.S.C. 154(b) by 0 days.

(21) Appl. No.: 11/522,813

(22) Filed: Sep. 18, 2006

(51) Int. Cl.
*E05B 27/06* (2006.01)

(52) U.S. Cl. ..... 70/358; 70/492; 70/401; 70/407

(58) Field of Classification Search ..... 70/358, 70/376, 378, 395, 401, 403, 407, 409
See application file for complete search history.

(56) References Cited

U.S. PATENT DOCUMENTS 344,412 A * 6/1886 Schroeder ..... 127/67
587,603 A * 8/1897 Piccioni ..... 70/355
1,584,204 A * 5/1926 Usiech ..... 70/43
2,023,207 A * 12/1935 Olson ..... 70/406
2,039,126 A * 4/1936 Svoboda ..... 70/358
2,620,649 A * 12/1952 Bernardo ..... 70/358
3,058,336 A * 10/1962 Tocchetto ..... 70/492
3,754,422 A * 8/1973 Stackhouse ..... 70/492
4,296,618 A * 10/1981 Guiraud ..... 70/358
4,429,554 A * 2/1984 Litvin et al. ..... 70/358
4,603,565 A * 8/1986 Strassmeir ..... 70/358
4,787,225 A * 11/1988 Hauser et al. ..... 70/401
5,148,690 A * 9/1992 Wang ..... 70/38 A
5,372,024 A * 12/1994 Ruckert ..... 70/406
6,076,386 A * 6/2000 Etchells et al. ..... 70/369
6,105,404 A * 8/2000 Field et al. ..... 70/365

* cited by examiner

*Primary Examiner*—Suzanne Dino Barrett

(57) ABSTRACT

A lock barrel and a driving part for the same comprises a plurality of key channels for the insertion o the driving part (key) and a plurality of transverse gateways for housing movable parts, which will bulge into the key channels for making the channels effectively small and therefore shielding them from illegally intruded tools.

7 Claims, 6 Drawing Sheets

LOCK BARREL AND A DRIVING PART FOR THE SAME

FIELD OF THE INVENTION

The present invention relates to locks, more particularly to a lock barrel that needs to be opened by a special key.

BACKGROUND OF THE INVENTION

Lock has evolved for hundred years, aiming at enhancing its antitheft function. Even locks with electronic devices, such as mechanisms for finger print and voice recognition, are invented, they are expensive to manufacture and maintain. Therefore, mechanical locks are still the main stream.

The lock barrel of a lock has a set of pins and associated recoil springs. A key to the lock can switch the positions of the pins, achieving the purpose of opening the lock. To open the lock without a key, a slim, elongated tool is inserted into the key channel in the lock barrel for activating the pins.

In other words, a lock barrel is the core mechanism of a lock and where an antitheft innovation should be applied to. One effective way of enhancing the antitheft function of a lock barrel is using a non-straight key channel, therefore making the intrusion of an illegal tool difficult. However, it is difficult to manufacture such a lock, since the key must be foldable; special materials should be used to make the key.

There is another way to enhance the antitheft function. Minimizing the key channel of a lock barrel so that external objects other than the key cannot be inserted into is an example. However, the production of this kind of key barrels concerns the building of molds of much better precision, which is expensive. Further, the key associated with a lock barrel of small key channel is usually structurally weak.

SUMMARY OF THE INVENTION

Accordingly, the primary objective of the present invention is to provide a lock barrel and a driving part for the same wherein the key channels have a plurality of transversely movable parts for making the channels effectively smaller, which can prevent the manufacturing problem of making lock barrel of small key channel.

The secondary objective of the present invention is to provide a lock barrel having two key channels, therefore increasing the difficulty of opening the lock illegally.

To achieve above object, the present invention provides a lock barrel and a driving part for the same. The present invention comprises an outer shell with a longitudinal receptacle; a central shaft disposed in said outer shell capable of rotating relative to said outer shell, said central shaft further comprising an outer wall and a plurality of coaxial key channels, said central shaft having one end open for the insertion of a driving part; and a plurality of movable parts slidably housed in respective gateways transverse to said shaft and connecting said key channels, each of said movable parts capable of being driving by said inserted driving part to move from a first position to a second position.

The lock barrel of the present invention utilizes driving part (key shaft) having arced cross sections for fitting the semi-circular key channels. A plurality of pin sets can be added in the key channels for reducing working space for a thief.

The various objects and advantages of the present invention will be more readily understood from the following detailed description when read in conjunction with the appended drawings.

DETAILED DESCRIPTION OF THE PREFERRED EMBODIMENTS

Figure 1:
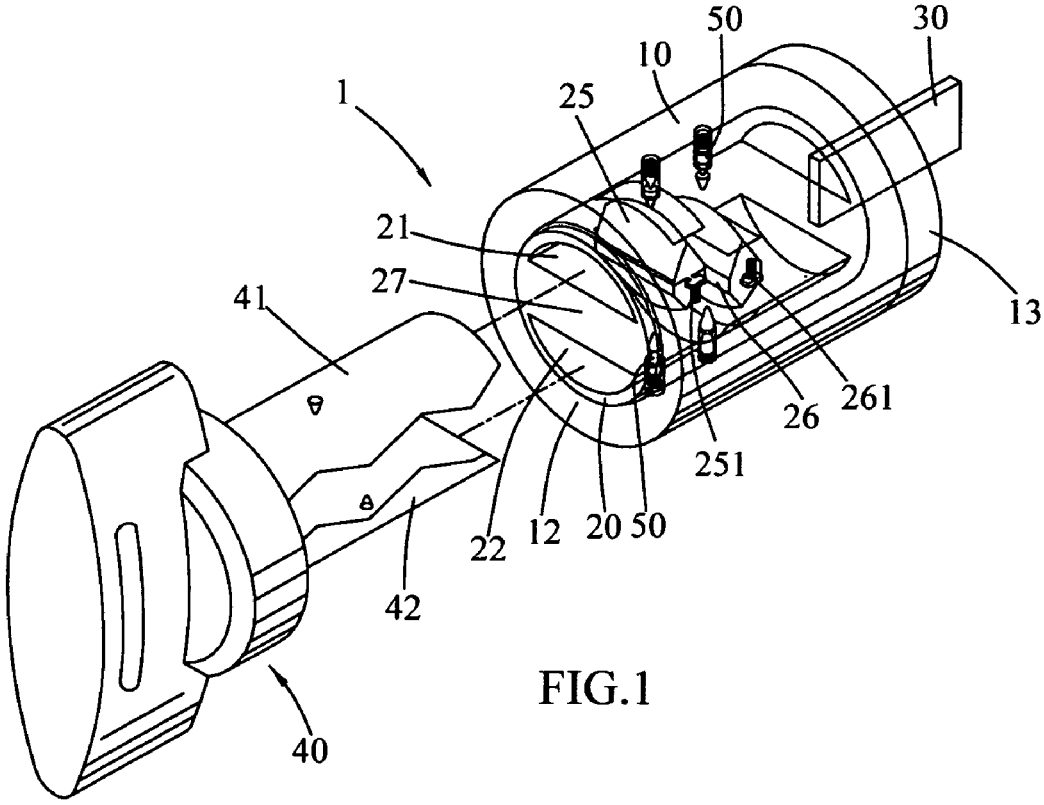
FIG. 1 is a perspective view of a lock barrel and a driving part of the present invention.
Figure 2:
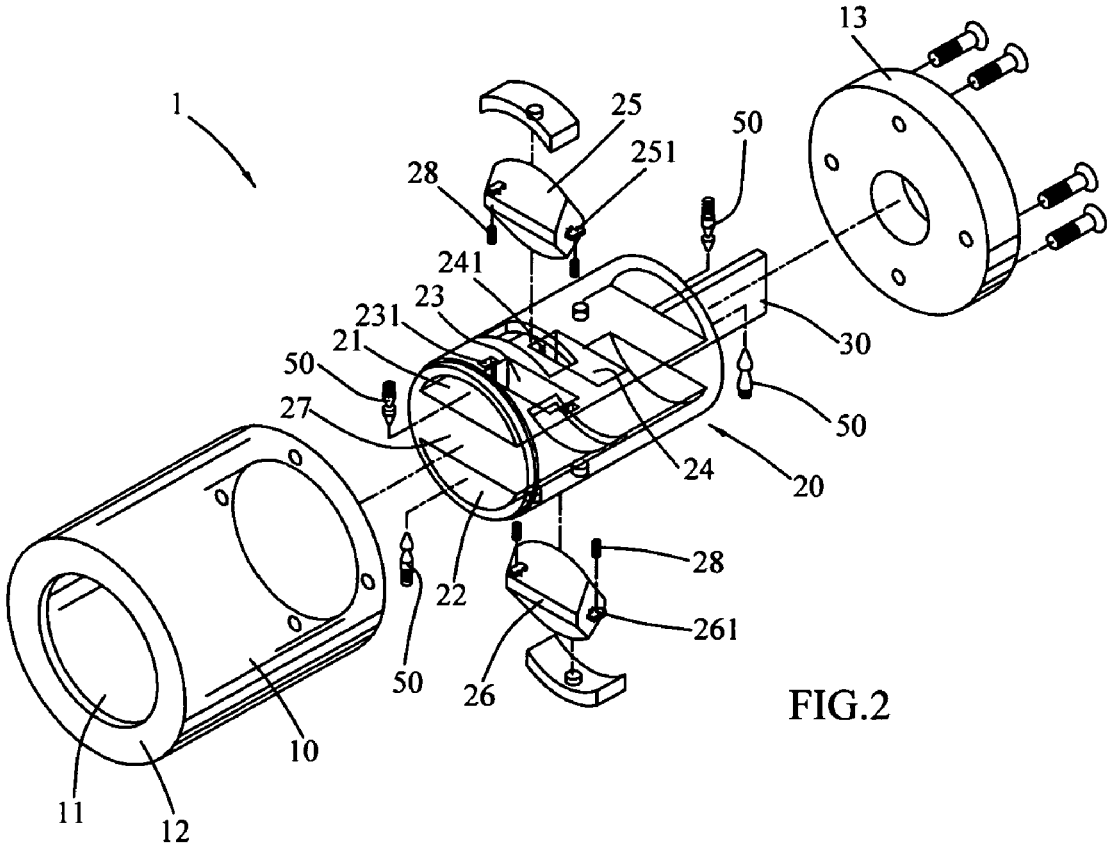
FIG. 2 is an exploded perspective view of the lock barrel of the lock barrel and a driving part in FIG. 1.

Referring to FIGS. 1 and 2, a lock barrel 1 of the present invention according to the present invention comprises a cylindrical lock shell 10 and an coaxial shaft 20 rotationally contained within an central receptacle 11, whereby the shaft 20 will rotate relative to the lock shell 10. The open end of the lock shell 10 is provided with a flange 12 for preventing the shaft 20 from sliding out. The other end of the lock shell 10 is sealed by an end cover 13 whereon a passive beam 30 is mounted for controlling a lock tongue.

Figure 3:
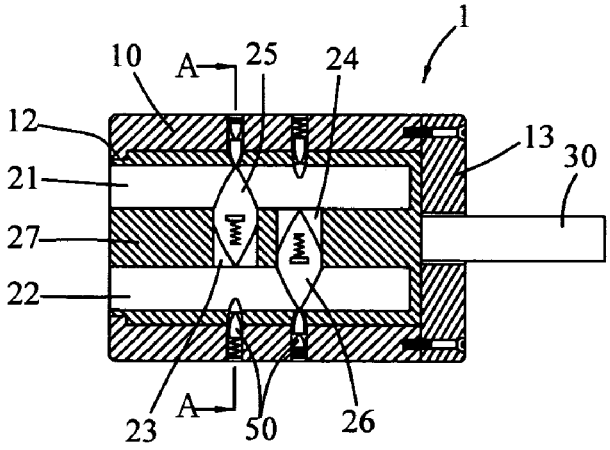
FIG. 3 is a lateral cross-sectional view of the lock barrel in FIG. 2.
Figure 3A:
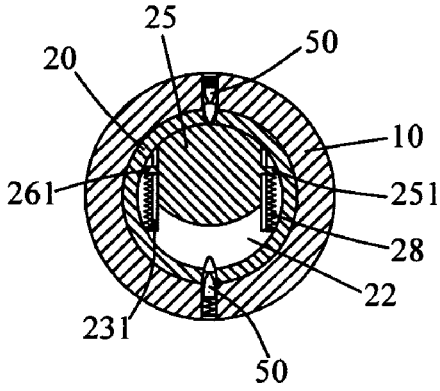
FIG. 3A is the A-A cross-sectional view of the lock barrel in FIG. 3.

Referring to FIGS. 3 and 3A, the shaft 20 further includes an outer surface and an inner space portioned by a divider slab 27 of predetermined thickness, whereby the inner space will he divided into two semi-circular first and second key channels 21, 22. There are a first gateway 23 and a second gateway 24 penetrating the divider slab 27 connecting the first key channel 21 and the second key channel 22. The first gateway 23 is close to the flange 12. Each of the first gateway 23 and the second gateway 24 respectively house a first movable part 25 and a second movable part 26. Each of the first movable part 25 and the second movable part 26 has a long end with an elliptic cross section and a short end with a diamond-shape cross section. Each of the movable parts 25, 26 is equipped with a T-shaped pins 251, 261, which in turn has slide channels 231, 241 for respectively housing the T-shaped pins 251, 261. The end of the slide channel 231 close to the first key channel 21 is closed, and the end of the slide channel 241 opposite to the slide channel 231 is closed too. The closed ends of the slide channel 231 and the slide channel 241 are disposed with recoil springs 28, being compressed by the T-shaped pins 251, 261.

To facilitate the installation of the movable parts, the outer surface of the shaft is provided with notches, in locations corresponding to the gateways on the divider slab, whereby the springs and the movable parts can be disposed therein first.

It should be noted that the long ends of the first movable part 25 and the second movable part 26 of the present invention are inserted into the first gateway 23 and the second gateway 24, so that the short ends thereof can be extend outward on the walls of the first key channel 21 and the second key channel 22.

Since the closed end of the slide channel 231 and the slide channel 241 are oriented differently, the first movable part 25 and the second movable part 26 are bulged respectively on the first key channel 21 and the second key channel 22.

A bulged pin set 50 of the prior art is installed in the lock shell 10, 180 degrees apart, which cannot rotate the lock barrel 1. Further, between the shaft 20 and the lock shell 10 there can be more than one depressed pin sets for improving the antitheft effect.

Figure 4:
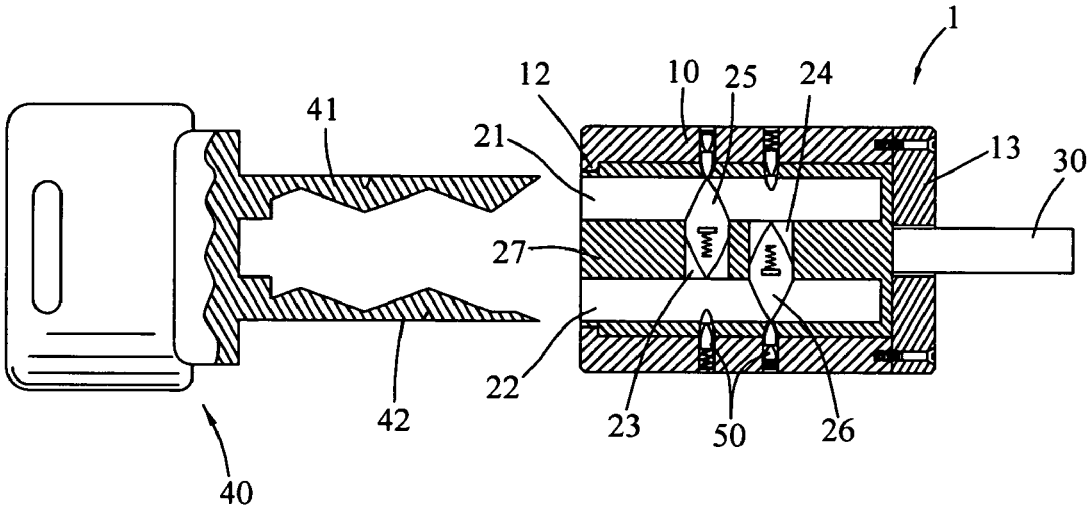
FIGS. 4 to 6 illustrate the action of the lock barrel and the driving part in FIG. 1.

Referring to FIGS. 1 and 4, a driving part 40, such as a key, has two parallel driving beams 41, 42. The front ends of the first driving beam 41 and the second driving beam 42 are slightly converged, with a central slot of width slightly larger than the thickness of the divider slab 27. The outer surfaces of the first driving beam 41 and the second driving beam 42 are semi-circular, precisely fitting the first key channel 21 and the second key channel 22. Further, the surfaces of the first driving beam 41 and the second driving beam 42 are provided with grooves corresponding to the depressed pin sets, and the inner surfaces thereof are provided with teeth sections.

Figure 5:
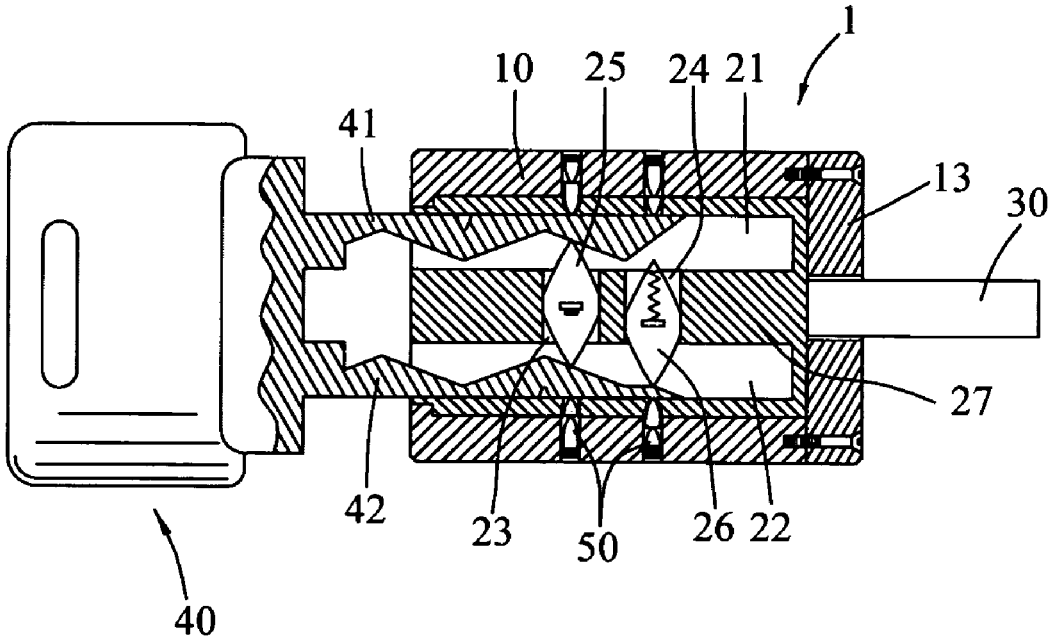
Figure 6:
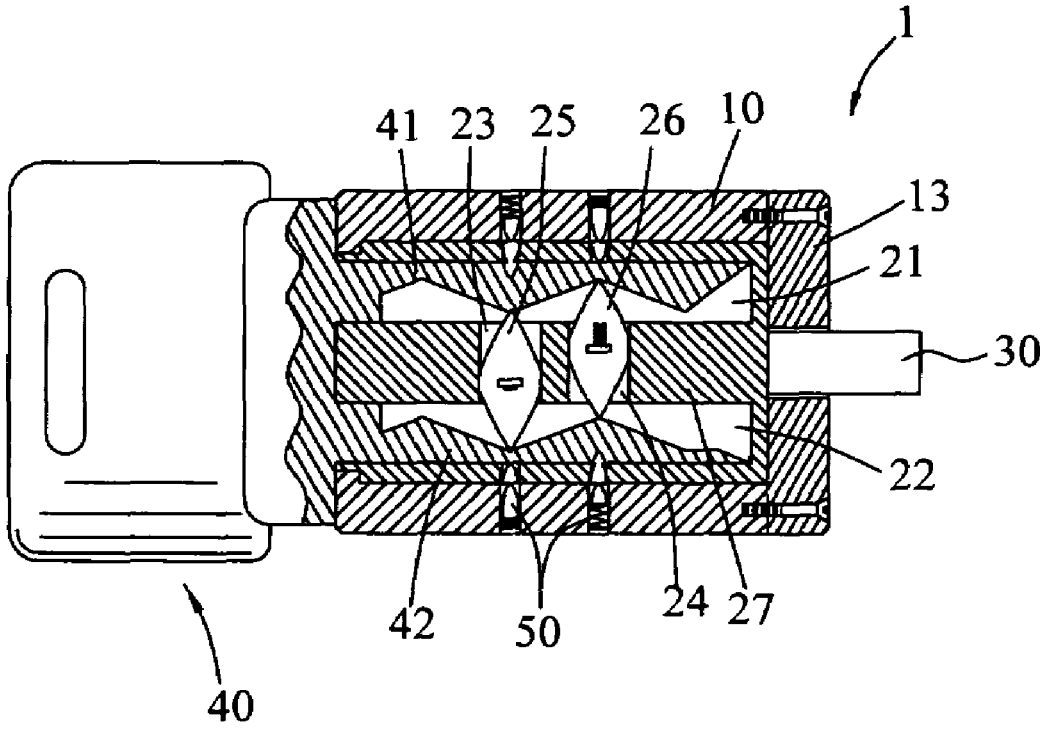

Thereby, when the driving part is inserted into the first and the second key channels within the lock barrel, the second driving beam will press the first movable part bulged on the second key channel (the movable part is in the first position). Since the tapered head of the movable part, it will be moved transverse to the channel along the slide channel, so that it will bulge into the first key channel (the movable part is in the second position) while letting the first driving beam pass through smoothly, as shown in FIG. 5. The driving part continues to move forward, and the first driving beam will push against the second movable part (the movable part is in the first position). Since the tapered head of the movable part, it will be moved transverse to the channel along the slide channel, so that it will bulge into the second key channel (the movable part is in the second position) while letting the second driving beam pass through smoothly. As the driving part is fully inserted, the grooves on the first and the second driving beams will be coupled with the plurality of depressed pin sets, attaining an open position, as shown in FIG. 6. At the same time, the bulged pin set will be pressed by the flat surfaces on the first and the second driving beams, attaining an open position too. Thereby, the rotation of the driving part will open the lock. When the driving part is pulled out, the movable parts within the lock barrel will come back to the first position as urged by recoil springs.

In this preferred embodiment there are only one depressed pin set and a bulged pin set; it is of course that the number of pin sets can be more than two, and the locations of them can be either first key channel or the second key channel. The nearer the locations of the pin sets, the smaller the working space for cracking the lock is, which may enhance the security of the lock. The number of the movable parts can also be increased to attain a better antitheft effect.

In the above preferred embodiment, the key channels have a plurality of transversely movable parts for minimizing the size of the channels effectively, thereby enhancing the antitheft effect by reducing the working space for illegally intruding tools.

At the same time, the key channels are not physically small; they are equivalently small due to the presence of the movable parts. Therefore, the manufacturing difficulty of making lock barrel of small key channels is solved.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A lock barrel and a driving part for the lock barrel, comprising:

an outer shell with a longitudinal receptacle;

a central shaft disposed in said outer shell capable of rotating relative to said outer shell, said central shaft further comprising an outer wall and a plurality of coaxial key channels, said central shaft having one end open for the insertion of a driving part; and a plurality of movable parts slidably housed in respective gateways transverse to said central shaft and connecting said key channels, each of said movable parts capable of being driven by said inserted driving part to move from a first position to a second position; and wherein a divider slab is placed along said receptacle of said outer shell so as to form two parallel key channels of semi-circular cross section.

2. The lock barrel and a driving part for the lock barrel of claim 1 wherein said gateways within said central shaft of said lock barrel are each installed with a recoil spring.

3. The lock barrel and a driving part for the lock barrel of claim 2 wherein each of said movable parts has a long end of elliptic cross section and a short end of diamond-shape cross section.

4. The lock barrel and a driving part for the lock barrel of claim 3 wherein said first position of each of said movable parts is when said movable part bulges into one of said key channels, closing said key channel.

5. The lock barrel and a driving part for the lock barrel of claim 4 wherein there are a plurality of pin sets between said central shaft and said outer shell.

6. The lock barrel and a driving part for the lock barrel of claim 5 wherein said driving part further includes two parallel driving beams having a central partition space of thickness slightly larger than that of said divider slab; an outer surface of each of said driving beams taking a curved shape to fit the corresponding one of said key channels of semi-circular cross section.

7. The lock barrel and a driving part for the lock barrel of claim 6 wherein said outer surface of each of said driving beams taking a curved shape to fit the corresponding one of said key channels; said outer surfaces of said driving beams being provided with grooves.

* * * * *